US012268249B2

(12) United States Patent
Cali et al.

(10) Patent No.: US 12,268,249 B2
(45) Date of Patent: Apr. 8, 2025

(54) AEROSOL-GENERATING DEVICE OR CASE WITH MULTIPLE POWER SOURCES

(71) Applicant: PHILIP MORRIS PRODUCTS S.A., Neuchâtel (CH)

(72) Inventors: Ricardo Cali, Mannheim (DE); Fabio Cantieri, Bologna (IT); Ivan Prestia, Calderara di Reno (IT)

(73) Assignee: Philip Morris Products S.A., Neuchâtel (CH)

( * ) Notice: Subject to any disclaimer, the term of this patent is extended or adjusted under 35 U.S.C. 154(b) by 340 days.

(21) Appl. No.: 17/779,305

(22) PCT Filed: Dec. 11, 2020

(86) PCT No.: PCT/IB2020/061850
§ 371 (c)(1),
(2) Date: May 24, 2022

(87) PCT Pub. No.: WO2021/117008
PCT Pub. Date: Jun. 17, 2021

(65) Prior Publication Data

US 2022/0408844 A1 Dec. 29, 2022

(30) Foreign Application Priority Data

Dec. 13, 2019 (EP) ..... 19215943

(51) Int. Cl.
*A24F 40/95* (2020.01)
*A24F 40/40* (2020.01)

(52) U.S. Cl.
CPC ..... *A24F 40/95* (2020.01); *A24F 40/40* (2020.01)

(58) Field of Classification Search
CPC ..... A24F 40/95; A24F 40/40; A24F 40/90; A24F 40/46; A24F 40/50; H02J 7/007
See application file for complete search history.

(56) References Cited

U.S. PATENT DOCUMENTS 5,692,526 A * 12/1997 Adams ..... A24C 5/01 131/365
5,853,915 A 12/1998 Suto
(Continued)

FOREIGN PATENT DOCUMENTS

CN 202076340 12/2011
EP 2403031 1/2012
(Continued)

OTHER PUBLICATIONS

International Preliminary Report on Patentability for PCT/IB2020/061850 by the European Patent Office on Mar. 30, 2022; 15 pgs.
(Continued)

*Primary Examiner* — Truc T Nguyen
(74) *Attorney, Agent, or Firm* — Mueting Raasch Group

(57) ABSTRACT

A charging case for an aerosol-generating device, the charging case including a case connector for receiving electrical power from an external source, a plurality of case cavities, a mounting section for connecting the aerosol-generating device to the charging case, and a case control unit. Each of the plurality of case cavities being configured to receive at least one of a plurality of power sources. The case control unit arranged to charge a first one of the plurality of power sources via the case connector using electrical power from the external power source and charge the aerosol-generating device connected to the mounting section via a second one of the plurality of power sources, or via the case connector using electrical power from the external power source.

20 Claims, 8 Drawing Sheets

(56) References Cited

U.S. PATENT DOCUMENTS

| | | | | |
|---|---|---|---|---|
| 10,945,462 | B2 | 3/2021 | Davis et al. | |
| 2009/0283103 | A1* | 11/2009 | Nielsen | A24F 40/60 131/273 |
| 2014/0007892 | A1 | 1/2014 | Liu | |
| 2015/0053217 | A1* | 2/2015 | Steingraber | A24F 40/50 131/329 |
| 2015/0114410 | A1* | 4/2015 | Doster | A24F 40/40 131/329 |
| 2015/0245668 | A1* | 9/2015 | Memari | A24F 40/90 206/250 |
| 2016/0366946 | A1* | 12/2016 | Murison | B67D 7/02 |
| 2017/0181471 | A1* | 6/2017 | Phillips | A61M 11/042 |
| 2020/0077699 | A1* | 3/2020 | Bagai | A24F 40/95 |
| 2021/0022409 | A1* | 1/2021 | Chia | H05B 1/0247 |
| 2022/0338544 | A1* | 10/2022 | Chan | A24F 40/60 |

FOREIGN PATENT DOCUMENTS

| | | | |
|---|---|---|---|
| JP | 2018-093877 | A | 6/2018 |
| WO | WO 2012/065754 | A2 | 5/2012 |
| WO | 20170053953 | | 3/2017 |
| WO | 20180178628 | | 10/2018 |

OTHER PUBLICATIONS

International Search Report and Written Opinion for PCT/IB2020/061850 by the European Patent Office on Mar. 9, 2021; 16 pgs.

European Search Report for EP 19215943.2 issued by the European Patent Office on Apr. 30, 2020; 9 pgs.

"Revolver Style Silver 18650 Mechanical Box Mod (3fvape.com)," [retrieved on May 21, 2022] from the Internet. Retrieved from the Internet: [URL: https://www.3fvape.com/mechanical-mod/12245-revolver-style-mechanical-box-mod-silver-aluminum-brass-2-x-18650.html?search_query=revolver&results=41#, XQdQFBYzZhE-Battery_Case]; 8 pgs.

Japanese Office Action for JP Application No. 2022-528602 issued by the Japanese Patent Office on Oct. 1, 2020; 6 pgs. including English machine translation.

* cited by examiner

AEROSOL-GENERATING DEVICE OR CASE WITH MULTIPLE POWER SOURCES

This application is the § 371 U.S. National Stage of International Application No. PCT/IB2020/061850, filed Dec. 11, 2020, which claims the benefit of European Application No. 19215943.2, filed Dec. 13, 2019, the disclosures of which are incorporated herein by reference.

The present invention relates to an aerosol-generating device or case having a plurality of power sources. Each of the plurality of power sources may be removable and/or selectable.

In some systems, an aerosol-generating device is configured to receive an aerosol-generating article comprising a solid aerosol-forming substrate, such as a gathered, crimped sheet of tobacco. In these systems, the device typically comprises an atomiser, which is arranged to heat the aerosol-forming substrate when the article is received in the device. The aerosol-generating article may also comprise a filter, which is wrapped together with the aerosol-forming substrate in the form of a rod, similar to a conventional cigarette. In other systems, the device is configured to receive a cartridge comprising an atomiser and a liquid aerosol-forming substrate. Such cartridges are often referred to as cartomisers. Common types of atomiser used in cartomisers comprise a coil of heater wire wound around an elongate wick soaked in liquid aerosol-forming substrate.

Heating the aerosol-forming substrate may be an energy-intensive process. Large energy storage units may be needed that increase the size and weight of the aerosol-generating devices and may negatively affect handling of such devices.

Some systems utilize an aerosol-generating device with sufficient energy storage for a single use in conjunction with a charging station or case with higher capacity energy storage. The aerosol-generating device may be removed from the charging station or case before use and reinserted into the charging station after use. The charging station or case may recharge the aerosol-generating device between each use. Other systems include a charging station or case with an additional aerosol-generating device. However, including a second aerosol-generating device may also double the need for cleaning such devices.

It would be desirable to provide a solution for allowing the uninterrupted use of an aerosol-generating device.

According to an aspect of the present invention, there is provided a charging case for an aerosol-generating device, the charging case comprising a case connector, a plurality of case cavities, a mounting section, and a case control unit. The case connector is for receiving electrical power from an external source. Each of the plurality of case cavities is configured to receive at least one of a plurality of power sources. The mounting section is for connecting the aerosol-generating device to the charging case. The case control unit is arranged to charge a first one of the plurality of power sources via the case connector using electrical power from the external power source and charge the aerosol-generating device connected to the mounting section via a second one of the plurality of power sources, or via the case connector using electrical power from the external power source.

Advantageously, incorporating a plurality of case cavities configured to receive at least one of a plurality of power sources may provide power source redundancy and ensure continued operability if one of the plurality of power sources fails. Additionally, incorporating a case control unit arranged to charge an aerosol-generating device via one of the plurality of power sources or via the case connector may diminish the load exerted on the plurality of power sources thereby extending their lifespan. For example, the plurality of power sources may not be simultaneously charged and discharged and the charging case can charge the aerosol-generating device directly from external power. Furthermore, the mounting section can provide power to and charge an aerosol-generating device while the device is being used.

According to another aspect of the present invention, there is provided an aerosol-generating device comprising a heater for heating an aerosol-forming substrate; a device housing comprising a plurality of power source cavities, wherein each of the plurality of power source cavities is configured to receive at least one of a plurality of power sources; and a selector arranged to select a first power source from the plurality of power sources inserted into the plurality of power source cavities and arranged to provide power to the heater from the selected first power source.

Advantageously, incorporating a plurality of power source cavities configured to receive at least one of a plurality of power sources may provide power source redundancy and ensure continued operability if one of the plurality of power sources fails. This also allows one of the plurality of power sources to be used to power the heater, while another different power source is being charged for later use.

According to another aspect of the present invention, there is provided a kit comprising the aerosol-generating device and the charging case.

The case control unit may be arranged to charge a plurality of the power sources via the case connector using electrical power from the external power source. Each one of the plurality of power sources may be removable and insertable into any one of the plurality of case cavities. Access to the case cavities may be provided via the mounting section.

Advantageously, providing a charging case with a plurality of device cavities for charging removable power sources allows depleted removable power sources to be recharged while the aerosol-generating device is in use. Defective power sources may also be removed and replaced without having to replace the entire charging case.

The shape of an external face of the mounting section may be shaped for receiving the aerosol-generating device. The mounting section may comprise one or more couplers for coupling the aerosol-generating device to the charging case. Each one of the plurality of power sources may be removable from and insertable into a corresponding one of the plurality of power source cavities.

The device housing may further comprise a charging port for charging a power source received in any of the plurality of power source cavities. The aerosol-generating device may be configured to control the power supplied to the heater from one or more of the plurality of power sources and maintain the power provided to the heater using any one or more of the plurality of power sources remaining in the power source cavities.

Advantageously, providing an aerosol-generating device with a charging port allows charging of the power sources without removing them from the device. Additionally, providing an aerosol-generating device that can selectively provide power from any one of the power sources allows for continuous use even if one of the batteries fails, becomes depleted, or is removed from the aerosol-generating device.

The device housing may comprise a power source portion and a cover portion. The power source portion may comprise the plurality of power source cavities. The cover portion may be for covering and providing access to the power source cavities of the power source portion. The power source portion and the cover portion may be configured to rotate relative to each other. The device housing may further comprise a mounting pin. The power source portion and the cover portion may be rotatably coupled to the mounting pin. The cover portion may comprise a window portion. The power source portion may be rotatable relative to the cover portion to expose at least one of the plurality of power source cavities through the window portion.

Advantageously, providing a device housing comprising a power source portion and a cover portion as described herein allows the removably power sources to be removed and replaced without during use.

The aerosol-generating device may further comprise a body portion comprising a protrusion. The power source portion may comprise at least one locking recess. The protrusion may be configured to engage the at least one locking recess to maintain a rotatable position of the power source portion.

Advantageously, providing an aerosol-generating device with a protrusion and locking recess allows for easily rotatably selecting one of the power sources or charging port while preventing the power source portion from rotating freely.

Each power source cavity may comprise a biasing element and an electrical contact. The biasing element may be configured to be compressed. The biasing element may be operable to engage the at least one of the plurality of power sources. The electrical contact may be configured to electrically couple to the at least one of the plurality of power sources when the biasing element is compressed by the at least one of the plurality of power sources.

Advantageously, providing biasing elements and contacts as described herein allows batteries to be secured in the aerosol-generating device and ensuring proper coupling of the electrical contacts.

According to this disclosure, there is further provided an aerosol-generating device comprising a heater for heating an aerosol-forming substrate and a device housing. The device housing comprises a plurality of power source cavities. Each of the plurality of power source cavities is configured to receive at least one of a plurality of power sources.

According to this disclosure, there is further provided an aerosol-generating system comprising a charging case and an aerosol-generating device. The charging case comprises a case power source and a case housing comprising a plurality of case cavities. Each of the plurality of case cavities is configured to receive at least one of a plurality of removable power sources. The case power source is configured to charge each of the plurality of removable power sources inserted in the plurality of case cavities. The aerosol-generating device comprises a heater for heating an aerosol-forming substrate and a device housing. The device housing comprises a power source cavity configured to receive at least one of a plurality of removable power sources.

Providing a plurality of power source cavities as described provides improved functionality of the aerosol-generating device since each the plurality of power source cavities can accommodate a removable power source. For example, each of the plurality of power source cavities can accommodate a removable power source thereby allowing the aerosol-generating device to accommodate at least two removable power sources. This may enable the aerosol-generating device to continue to provide power to the heater while a depleted removable power source is exchanged for a charged removable power source. Additionally, the aerosol-generating device may switch power consumption from a low or depleted removable power source to a charged removable power source. Such functionality may provide aerosol-generating devices that are suitable for continuous use by multiple users or a single user who desires to use the device for longer than a single use. Additionally, the removable power sources may be replaced when they have worn out or no longer hold a suitable charge.

Preferably, the device housing further comprises a charging port to charge a removable power source received in any of the plurality of power source cavities.

Preferably, the aerosol-generating device is configured to control the power supplied to the heater from one or more of the plurality of removable power sources and maintain the power provided to the heater using any one or more of the plurality of removable power sources remaining in the power source cavities.

Preferably, the device housing comprises a power source portion comprising the plurality of power source cavities and a cover portion for covering and providing access to the power source cavities of the power source portion. The power source portion and the cover portion may be configured to rotate relative to each other. The aerosol-generating device may further comprise a mounting pin. The power source portion and the cover portion may be rotatably coupled to the mounting pin. Preferably, the cover portion comprises a window portion. The power source portion may be rotatable relative to the cover portion to expose at least one of the plurality of power source cavities through the window portion. The cover portion may be rotatable to expose at least one of the plurality of power source cavities through the window portion.

Preferably, the aerosol-generating device further comprises a body portion comprising a protrusion and the power source portion comprises at least one locking recess. The protrusion may be configured to engage the at least one locking recess to maintain a rotatable position of the power source portion.

Preferably, the device cavity comprises a biasing element and an electrical contact. The biasing element may be configured to be compressed. The biasing element may be operable to engage the at least one of the plurality of removable power sources. The electrical contact may be configured to electrically couple to the at least one of the plurality of removable power sources when the biasing element is compressed by the at least one of the plurality of removable power sources.

Preferably, the plurality of power source cavities each comprise a hexagonally shaped cross section.

Preferably, the charging case further comprises electronics configured to charge one or more of the plurality of power sources based upon a current supply capability of the case power source.

Preferably, the charging case further comprises a charger port to charge the case power source, one or more of the plurality of power sources, or both the case power source and the one or more of the plurality of power sources.

Preferably, the charging case further comprises a mounting section configured to receive the aerosol-generating device. The mounting section may comprise one or more couplers to couple to the aerosol-generating device. Access to the case cavities may be provided via the mounting section. The shape of an external face of the mounting section may be shaped to receive the aerosol-generating device.

Preferably, the one or more couplers comprise one or more magnets.

Advantageously, aerosol-generating devices that include a plurality of power source cavities as described herein may provide a simple way to extend continuous use time without needing to significantly increase the size and weight of the device. As a result, a single aerosol-generating device may be used for as long as charged power sources are available. Furthermore, removable power sources are replaceable as the removable power sources wear out or no longer hold enough charge to power the aerosol-generating device. Still further, providing a charging case with a plurality of device cavities for charging removable power sources allows depleted removable power sources to be recharged while the aerosol-generating device is in use.

As used herein, the term "aerosol-generating article" is used herein to denote an article wherein an aerosol-generating substrate is heated to produce and deliver inhalable aerosol to a consumer. As used herein, the term "aerosol-generating substrate" denotes a substrate capable of releasing volatile compounds upon heating to generate an aerosol.

As used herein, the term "aerosol-generating device" refers to a device comprising a heater element that interacts with the aerosol-generating substrate of the aerosol-generating article to generate an aerosol.

As used herein, the term "charging case" refers to a case capable of receiving at least one power source in each of a plurality of case cavities and charging received power sources. The charging case may include a housing and a mounting section. The housing may generally form the shape of the charging case. The mounting section may be configured to receive the aerosol-generating device. The charging case may be configured to charge power sources of the aerosol-generating device when the aerosol-generating device is received in the mounting section. The charging case may include a case power source configured to charge received power sources. The charging case may include electronics configured to charge one or more power sources based on a current supply capability of the case power source.

As used herein, the term "cavities" refers to a volumetric space defined in an object or housing that may extend between an open end and a closed end. The sides of the cavity that extend between the ends may be enclosed by the object or housing.

As used herein, the term "power source" refers to an energy storage device. Energy storage devices may include, for example, batteries, lithium-ion batteries, rechargeable batteries, fuel cells, or other forms of energy storage. Removable power sources may include a body, a head, and electrical contacts. The body may be configured to store energy. The stored energy may be electrical energy, chemical energy, or other form of energy storage. The power source may have an energy capacity in a range of about 250 mAh to about 600 mAh. The electrical contacts may be configured to electrically couple with electrical contacts of an aerosol-generating device or a charger case.

The removable power source may have a hexagonal shaped cross-sectional area. Alternatively, the power source may have a square or circular cross-sectional area, or any other suitable cross-sectional area. The head may have a larger cross-sectional area than the body. Providing a head with a larger cross-sectional area than the body may provide easier handling for a user. The body may extend along a length or axis between the head and the electrical contacts. In other words, the head may be located at a distal end of the removable power source and the electrical contacts may be located at a proximal end of the removable power source. The electrical contacts may electrically couple the energy stored in the removable power source to an aerosol-generating device, a charging case, a power source, or an energy source. The electrical contacts may include any suitable electrically conductive material.

An aerosol-generating system may include a charging case and an aerosol-generating device. The aerosol-generating device may include a heater and a device housing. The device housing may include a heater portion, a cover portion, a power source portion, and power source cavities. The device housing may have a length that extends along an axis between a distal end and a proximal end. The device housing may have a length in a range of about 200 mm to about 120 mm. Preferably, the device housing may have a length of about 140 mm to about 160 mm. The device housing may have a length of about 150 mm to about 155 mm. The device housing may have a length of about 153 mm. The device housing may have a diameter or width in a range of about 25 mm to about 35 mm. Preferably the device housing has a diameter or width of about 30 mm.

The heater portion may have a length that extends along an axis from the distal end of the aerosol-generating device. The heater portion may include or define a heater cavity. The heater may be located in the heater cavity. The heater cavity may be configured to receive an aerosol-generating article. The heater cavity may have a diameter in a range of about 6 mm to about 10 mm. Preferably, the heater cavity may have a diameter of about 8 mm. The heater may be configured to pierce aerosol-generating articles that are received in the heater cavity. Additionally, the heater may be configured to heat the received aerosol-generating articles.

The power source portion may abut the heater portion. The power source portion may rotatably attached or coupled to the heater portion. For example, the power source portion may include a mounting pin that is rotatably coupled to the heater portion. The power source portion may be rotatable about the axis that extends along the length of the aerosol-generating device and device housing. In other words, the power source portion may be rotatable relative to the heater portion or cover portion. The power source portion may include one or more locking recesses. As used herein, the term "recess" refers to an indentation, dimple, or notch. The one or more locking recesses may be configured to interact with one or more protrusions to maintain a rotational position of the power source portion or cover portion. The power source portion or cover portion may include a number of rotational positions or locking positions. The heater portion or cover portion may include the one or more protrusions configured to engage the one or more locking recesses.

The power source portion may have a diameter in a range of about 24 mm to about 34 mm. Preferably, the power source portion may have a diameter of about 29 mm. The power source portion may have a length that extends along the axis from the heater portion towards the proximal end of the aerosol-generating device.

The cover portion may cover at least a portion of the power source portion. The cover portion may have a length that extends along the axis from the heater portion to the proximal end of the aerosol-generating device. The cover portion may include a gap along the length of the cover portion that exposes a surface of the power source portion along the length of the power source portion. The gap in the cover portion may have a length in a range of about 10 mm to about 20 mm. Preferably the gap in the cover portion has a length of about 15 mm. The gap in the cover portion may allow the power source portion to be rotated relative to the heater portion or the cover portion. In other words, a user may be able to rotate the power source portion by gripping the heater portion or cover portion and spinning or turning the power source portion by applying pressure on the power source portion exposed by the gap in the cover portion. The cover portion may be fixed relative to the heater portion. Alternatively, the cover portion may be rotatable relative to the heater portion and the power source portion may be fixed relative to the heater portion.

The power source portion may include or define a plurality of power source cavities. The power source cavities may have an open end towards the proximal end of the aerosol-generating device and a closed end toward the heater portion. Each of the power source cavities may have a biasing element configured to be compressed. The biasing elements may be located at the closed end of the power source cavities. The biasing elements may be operable to engage removable power sources received in the power source cavities. The biasing elements may include an elastic protrusion, a spring, or other suitable device for engaging the removable power sources. The biasing elements may allow for easy removal of removable power sources when such removable power sources are not secured in the power source cavities. The removable power sources may not be secured in the power cavities when the cover portion exposes the removable power sources.

The power source cavities may include electrical contacts. The electrical contacts may be located proximal the closed end of the power source cavities. The electrical contacts may be operably coupled to heater by circuitry. The aerosol-generating device may be configured control power supplied to the heater from one or more of a plurality of removable power sources received in power source cavities. The aerosol-generating device may further be configured to maintain the power provided to the heater using any one or more of the plurality of removable power sources remaining in the power source cavities. The circuitry may include any suitable electronics or devices for controlling power provided to the heater. For example, the circuitry may operably couple each of the power source cavities or received removable power sources in parallel to the heater. Such a configuration would allow the aerosol-generating device to provide power at a voltage equal to or lower than the maximum voltage of a removable power source. In another example, the circuitry may include a controller to control the power provided to the heater. The controller may include one or more processors, memory, logic units, or other electronics to provide power control of the aerosol-generating device.

Dynamically providing power from one or more power sources as described herein allows power to be provided to the heater while depleted power sources are removed and replaced with charged power sources. This allows for sustained and uninterrupted use of the aerosol-generating device even when one of the power sources has been depleted. Accordingly, the aerosol-generating device as described herein may be used for multiple sessions or multiple people without the need to wait for batteries to recharge in between single uses or after use by a single user.

The power source portion may include a charger port. The charger port may be located at a proximal end of the power source portion. The charger port may be located adjacent to or proximal the open end of the power source cavities. The charger port may be configured to couple to a charging cable. The charger port may be electrically coupled to the electrical contacts to provide power for charging removable power sources. The charger port may be operably coupled to circuitry of the aerosol-generating device. The circuitry of the aerosol-generating device may include a controller. The controller may be configured to control charging of removably power sources through the charging port.

The cover portion may include a window portion. The window portion may be located at the proximal end of the aerosol-generating device. The window portion may be configured to expose the charging port or one of the plurality of power source cavities. The window portion may be configured to expose one of such features at each rotational position provided by the one or more locking recesses.

The cover portion may hold the removable power sources within the power source cavities. The cover portion may press the removable power sources against the biasing elements such that the biasing elements are compressed when the cover portion covers the removable power sources. The cover portion may include an angled edge along an edge of the window portion to allow the cover portion to smoothly press the removable power sources into the power source cavities during rotation of the power source portion or cover portion. When the removable power sources are exposed by the window portion the biasing elements may push the heads of the removable power sources out of the power source cavities to enable easy removal of the removable power sources.

Alternatively, each of the power source cavities may include a retention element at the cavity openings. Retention elements may include elastic protrusions, releasable tabs, or other devices to hold removable power sources in the power source cavities. Retention elements may be used when an aerosol-generating device does not have a cover portion. When the retention elements are released or removed the biasing elements may push the heads of the removable power sources out of the power source cavities to enable easy removal of the removable power sources.

The charging case may include a case power source and a case housing. Preferably, the length of an aerosol-generating device configured to be used with the charging case and the length of the charging case are substantially the same. The length of an aerosol-generating device configured to be used with the charging case and the length of the charging case may be different to each other. In one example, the charging case may include a plurality of power sources.

The case housing may have a length in a range of about 130 mm to about 180 mm. The case housing may have a length in a range of about 140 mm to about 160 mm. Preferably, the case housing may have a length in a range of about 150 mm to about 155 mm. Preferably the case housing has a length of about 153 mm. The case housing may have a width in a range of about 30 mm to about 50 mm. Preferably, the case housing has a width of about 40 mm. The case housing may have a height in a range of about 40 mm to about 75 mm. Preferably, the case housing has a height of about 57 mm.

The charging case may include a mounting section configured to receive an aerosol-generating device. The mounting section may extend along the length of a side of the charging case. The mounting section may be shaped to receive an aerosol-generating device. For example, the mounting section may include a semi-circular depression or trench extending along the length of the side of the charging case. The mounting section may include one or more couplers to releasably retain the aerosol-generating device to the mounting section. The one or more couplers may include one or more magnets or magnetic material.

In another example, the mounting section may include a device cavity extending into a surface of the charging case. The device cavity may be shaped to receive at least a portion of an end of an aerosol-generating device. The device cavity may include a mounting section charger port configured to operably couple to a charger port of the aerosol-generating device. The device cavity may include one or more couplers to releasably retain the aerosol-generating device to the mounting section. The one or more couplers may include one or more magnets or magnetic material.

The case housing may include a plurality of case cavities. Each of the case cavities may be configured to receive at least one of a plurality of power sources. The charging case may be configured to charge one or more of the plurality of power sources when received in the plurality of case cavities. Each of the case cavities may include a biasing element at the closed end of the case cavities to engage a power source received therein. The biasing elements may be configured to be compressed. Each of the case cavities may include one or more electrical contacts to electrically couple any received power sources to the charging case. The electrical contacts may be located proximal to the closed end of the case cavities. The electrical contacts may include any suitable electrically conductive material. Access to the case cavities may be located in the mounting section. In other words, the open end of the case cavities may be located in the mounting section. The open ends of the case cavities may be exposed upon removal of an aerosol-generating device from the mounting section. Upon such removal of an aerosol-generating device from the mounting section, the power sources located within the case cavities may be pushed out of the case cavities by the biasing elements. The presence of an aerosol-generating element in the mounting section may be configured to retain the power sources within the case cavities.

The charging case may include electronics configured to charge one or more power sources received in the charging case based upon a current supply capability of the case power source. The electronics may further be configured to charge the plurality of power sources based on a voltage of each of the plurality of power sources. The electronics may include one or more processors, controllers, memory, logic units, or other circuitry to control charging of power sources.

The charging case may further include a charger port to charge the case power source, one or more of the plurality of power sources, or both the case power source and the one or more of the plurality of power sources. The charger port may be operably coupled to the electronics, the case power source, or the electrical contacts. The charger port may include any suitable input or interface to couple to a charging cable.

In another embodiment, the charger port is operably coupled to a case control unit. The case control unit may be operably coupled to a mounting section charger port and each of the plurality of power sources. The case control unit may be arranged to charge one or more of the plurality of power sources via external power from the charger port. The case control unit may be further configured to charge an aerosol-generating device using external power from the charger port or using electrical power from one or more of the plurality of power sources. The control unit may be configured to detect when an aerosol-generating device is received in the mounting section. The control unit may be configured to determine a charge level of the plurality of power sources or the aerosol-generating device. The control unit may be configured to charge the plurality of power sources or the aerosol-generating devices based on the detected charge level.

The charging case may include a storage portion. The storage portion may be configured to receive aerosol-generating articles or aerosol-generating device accessories.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

Below there is provided a non-exhaustive numbered list of non-limiting examples. Any one or more of the features of these examples may be combined with any other one or more features of another example, embodiment, or aspect described herein.

1: A charging case for an aerosol-generating device, the charging case comprising a case connector for receiving electrical power from an external source; a plurality of case cavities, each of the plurality of case cavities being configured to receive at least one of a plurality of power sources; a mounting section for connecting the aerosol-generating device to the charging case; a case control unit arranged to charge a first one of the plurality of power sources via the case connector using electrical power from the external power source; and charge the aerosol-generating device connected to the mounting section via a second one of the plurality of power sources, or via the case connector using electrical power from the external power source.

2: The charging case according to example 1, wherein the case control unit is arranged to charge a plurality of the power sources via the case connector using electrical power from the external power source.

3: The charging case according to example 1 or example 2 wherein each one of the power sources is removable and insertable into any one of the plurality of case cavities.

4: The aerosol-generating system according to any one of the preceding examples, wherein the mounting section comprises one or more couplers for coupling the aerosol-generating device to the charging case.

5: The aerosol-generating system according to example 4, wherein access to the case cavities is provided via the mounting section.

6: The aerosol-generating system according to any one of the preceding examples, wherein the shape of an external face of the mounting section is shaped for receiving the aerosol-generating device.

7: An aerosol-generating device comprising a heater for heating an aerosol-forming substrate; a device housing comprising a plurality of power source cavities, wherein each of the plurality of power source cavities is configured to receive at least one of a plurality of power sources; a selector arranged to select a first power source from the plurality of power sources inserted into the plurality of power source cavities and arranged to provide power to the heater from the selected first power source.

8: The aerosol-generating device according to example 7, wherein each one of the plurality of power sources is removable from and insertable into a corresponding one of the plurality of power source cavities.

9: The aerosol-generating device according to example 7 or example 8, wherein the device housing further comprises a charging port for charging a removable power source received in any of the plurality of power source cavities.

10: The aerosol-generating device according to any one of examples 7 to 9, wherein the aerosol-generating device is configured to control the power supplied to the heater from one or more of the plurality of removable power sources; and maintain the power provided to the heater using any one or more of the plurality of removable power sources remaining in the power source cavities.

11: The aerosol-generating device according to any one of examples 7 to 10, wherein the device housing comprises a power source portion comprising the plurality of power source cavities; and a cover portion for covering and providing access to the power source cavities of the power source portion; and wherein the power source portion and the cover portion are configured to rotate relative to each other.

12: The aerosol-generating device according to any one of examples 7 to 11, wherein the device further comprises a mounting pin, and wherein the power source portion and the cover portion are rotatably coupled to the mounting pin.

13: The aerosol-generating device according to one of examples 7 to 12, wherein the cover portion comprises a window portion, wherein the power source portion is rotatable relative to the cover portion to expose at least one of the plurality of power source cavities through the window portion.

14: The aerosol-generating device according to any one of examples 7 to 13, wherein thel aerosol-generating device further comprises a body portion comprising a protrusion and the power source portion comprises at least one locking recess, and wherein the protrusion is configured to engage the at least one locking recess to maintain a rotatable position of the power source portion.

15: The aerosol-generating device according to any one of examples 7 to 14, wherein each power source cavity comprises a biasing element configured to be compressed, the biasing element operable to engage the at least one of the plurality of removable power sources; and an electrical contact configured to electrically couple to the at least one of the plurality of removable power sources when the biasing element is compressed by the at least one of the plurality of removable power sources.

16: A kit comprising the aerosol-generating device according to any one of examples 7-15, and a charging case according to any one of examples 1-6.

17: An aerosol-generating device comprising a heater for heating an aerosol-forming substrate; and a device housing comprising a plurality of power source cavities, wherein each of the plurality of power source cavities is configured to receive at least one of a plurality of removable power sources.

18: The aerosol-generating device according to example 17, wherein the device housing further comprises a charging port to charge a removable power source received in any of the plurality of power source cavities.

19: The aerosol-generating device according to any one of examples 17 to 18, wherein the aerosol-generating device configured to control the power supplied to the heater from one or more of the plurality of removable power sources; and maintain the power provided to the heater using any one or more of the plurality of removable power sources remaining in the power source cavities.

20: The aerosol-generating device according to any one of examples 17 to 19, wherein the device housing comprises a power source portion comprising the plurality of power source cavities; and a cover portion for covering and providing access to the power source cavities of the power source portion; and wherein the power source portion and the cover portion are configured to rotate relative to each other.

21: The aerosol-generating device according to any one of examples 17 to 20, wherein the device further comprises a mounting pin, and wherein the power source portion and the cover portion are rotatably coupled to the mounting pin.

22: The aerosol-generating device according to any one of examples 17 to 21, wherein the cover portion comprises a window portion, wherein the power source portion is rotatable relative to the cover portion to expose at least one of the plurality of power source cavities through the window portion.

23: The aerosol-generating device according to any one of examples 17 to 22, wherein the cover portion is rotatable to expose at least one of the plurality of power source cavities through the window portion.

24: The aerosol-generating device according to any one of examples 20 to 23, wherein the aerosol-generating device further comprises a body portion comprising a protrusion and the power source portion comprises at least one locking recess, and wherein the protrusion is configured to engage the at least one locking recess to maintain a rotatable position of the power source portion.

25: The aerosol-generating device according to any one of examples 17 to 24, wherein the power source cavity comprises a biasing element configured to be compressed, the biasing element operable to engage the at least one of the plurality of removable power sources; and an electrical contact configured to electrically couple to the at least one of the plurality of removable power sources when the biasing element is compressed by the at least one of the plurality of removable power sources.

26: An aerosol-generating system comprising a charging case comprising a case power source; and a case housing comprising a plurality of case cavities, each of the plurality of case cavities being configured to receive at least one of a plurality of removable power sources, wherein the case power source is configured to charge each of the plurality of removable power sources inserted in the plurality of case cavities; and an aerosol-generating device comprising a heater for heating an aerosol-forming substrate; and a device housing comprising a power source cavity configured to receive at least one of a plurality of removable power sources.

27: The aerosol-generator system according to example 26, wherein the charging case further comprises electronics configured to charge one or more of the plurality of removable power sources based upon a current supply capability of the case power source.

28: The aerosol-generator system according to any one of examples 26 to 27, wherein the charging case further comprises a charger port to charge the case power source, one or more of the plurality of removable power sources, or both the case power source and the one or more of the plurality of removable power sources.

29: The aerosol-generator system according to any one of examples 26 to 28, wherein the charging case further comprises a mounting section configured to receive the aerosol-generating device and wherein the mounting section comprises one or more couplers to couple to the aerosol-generating device.

30: The aerosol-generator system according to example 29, wherein access to the case cavities is provided via the mounting section.

31: The aerosol-generator system according to any one of examples 29 to 30, wherein the shape of an external face of the mounting section is shaped to receive the aerosol-generating device.

Figure 1A:
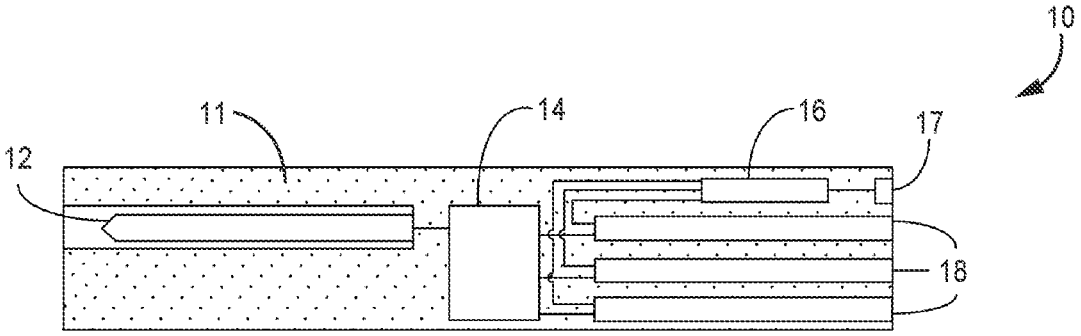
FIG. 1A is a schematic diagram of an aerosol-generating device.

The aerosol-generating devices and systems depicted in FIGS. 1-8 illustrate one or more embodiments of aerosol-generating devices, charging cases, and aerosol-generating systems described above. The schematic drawings are not necessarily to scale and are presented for purposes of illustration and not limitation. The drawings depict one or more aspects described in this disclosure. However, it will be understood that other aspects not depicted in the drawings fall within the scope and spirit of this disclosure.

The aerosol-generating device depicted in FIG. 1A illustrates an aerosol-generating device 10 that includes a device housing 11 and a heater 12 for heating an aerosol-forming substrate. The device housing 11 includes a plurality of power source cavities 18. Each of the plurality of power source cavities 18 is configured to receive at least one of a plurality of power sources.

Each one of the plurality of power sources may be removable from and insertable into the aerosol-generating device 10. For example, each one of the plurality of power sources may be removable from aerosol-generating device 10 without requiring the use of a tool so that the power sources can be removed using a user's hand alone. Alternatively, the plurality of power sources may be permanently fixed in the aerosol-generating device 10. For example, use of a tool (such as a screwdriver) may be required in order to remove each one of the plurality of power sources from the aerosol-generating device 10 so that the power sources cannot be removed using a user's hand alone.

The aerosol-generating device 10 includes a selector arranged to select a power source from the plurality of power sources inserted into the plurality of power source cavities 18 and to provide power to the heater 12 from the selected removable power source. The selector may include any suitable circuitry or electronics such as circuitry 14 to select a removable power source and provide power to the heater 12 from such removable power source. The selector may include any suitable apparatus including a switch or a rotatable battery chamber to select a power source. The selector may include a rotatable power source portion such as the power source portions shown in FIGS. 3A-3D, 4A-4C, and 5A-5D.

The aerosol-generating device 10 includes circuitry 14. The circuitry 14 may include any suitable electronics or devices for controlling power provided to the heater 12. For example, the circuitry 14 may operably couple each of the power source cavities 18 or received removable power sources in parallel to the heater 12. Such a configuration would allow the aerosol-generating device to provide power at a voltage equal to or lower than the maximum voltage of a removable power source. In another example, the circuitry 14 may include a controller to control the power provided to the heater 12. The controller may include one or more processors, memory, logic units, or other electronics to provide power control.

The aerosol-generating device 10 includes circuitry 16 and a charging port 17. The circuitry 16 may include any suitable electronics or devices for controlling power received from the charging port 17. The charging port 17 may be coupled to an external power source such as a charging case or coupled to an electrical outlet using an adapter. The circuitry 16 may operably couple each of the power source cavities 18 or received power sources in parallel to an external power source and control charging of the received power sources. In an example, the circuitry 16 may include a controller to control the power provided to the received power sources. The controller may include one or more processors, memory, logic units, or other electronics to provide power control. In another example, the circuitry 14 and the circuitry 16 are a single controller configured to control charging of the power sources and providing power to the heater 12.

Figure 1B:
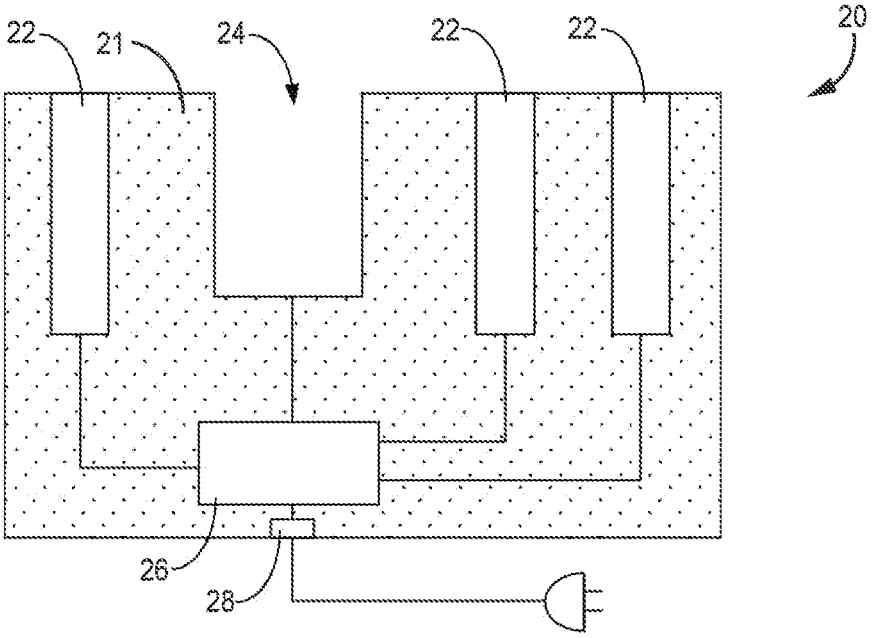
FIG. 1B is a schematic diagram of a charging case.

FIG. 1B illustrates a charging case 20 that includes a case housing 21, a case connector 28, a plurality of case cavities 22, a mounting section 24, and a case control unit 26. The case connector 28 is arranged to receive power from an external source. Each of the plurality of case cavities 22 is configured to receive at least one of a plurality of power sources. The mounting section 24 can be connected to an aerosol-generating device such as the aerosol-generating device 10 of FIG. 1A.

The case control unit 26 is arranged to control charging of the plurality of power sources in the plurality of case cavities 22 and the aerosol-generating device received in the mounting section 24. The case control unit 26 receives power via the case connector 28 and provides power to the plurality of power sources and the aerosol-generating device. The case control unit 26 may also receive power from one or more of the plurality of power sources and provide such power to the aerosol-generating device. The case control unit 26 may provide power based on a charge of the plurality of power sources and the aerosol-generating device. In one example, the case control unit 26 is arranged to charge a first one of the plurality of power sources via the case connector 28 using electrical power from the external power source; and charge the aerosol-generating device connected to the mounting section 24 via a second one of the plurality of power sources, or via the case connector using electrical power from the external power source. The case control unit 26 may include one or more processors, memory, logic units, or other electronics to provide power control.

The case control unit 26 may provide power to at least one of the power sources in a case cavity 22 directly from the external power source (i.e. not via or through another power source). The case control unit 26 may provide power to the aerosol-generating device 10 directly from at least one of the power sources in a case cavity 22 (i.e. not via or through another power source).

Figure 2:
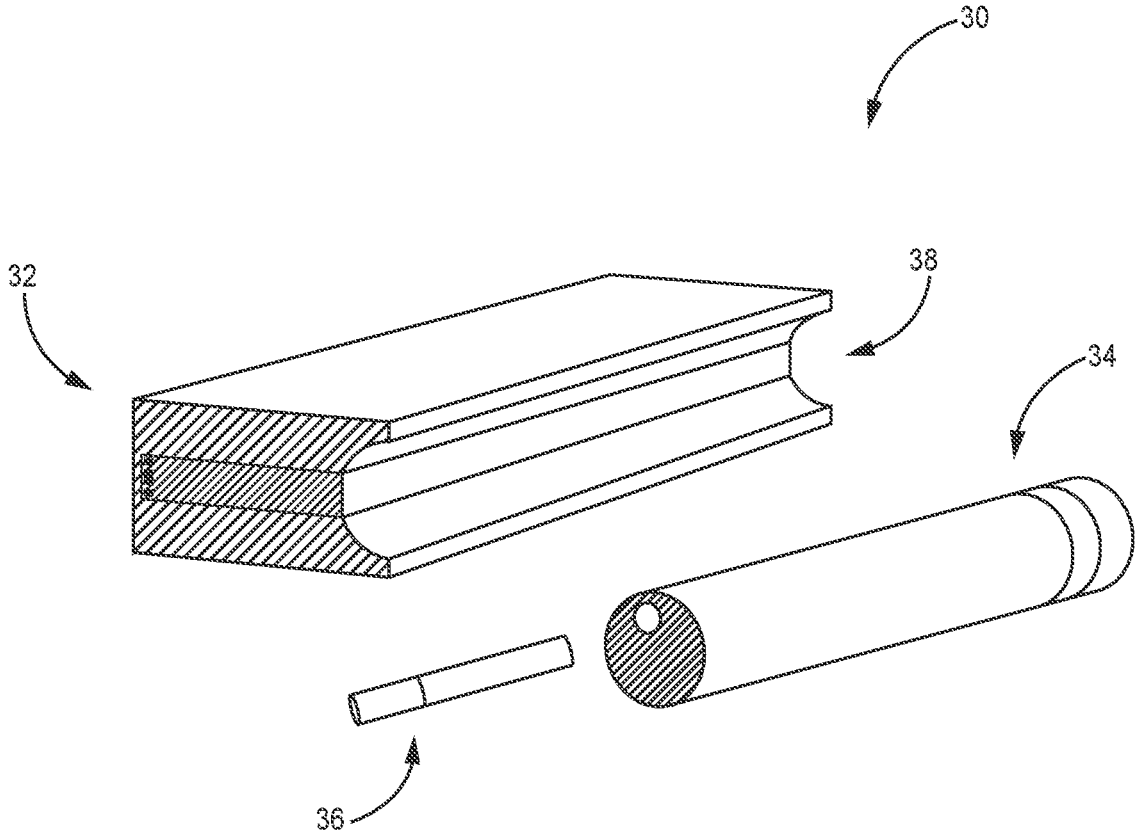
FIG. 2 is a schematic diagram of a charging case and an aerosol-generating device.

The aerosol-generating system depicted in FIG. 2 illustrates an aerosol-generating system 30 that includes a charging case 32, an aerosol-generating device 34, and an aerosol-generating article 36. The charging case 32 may include case power source and a case housing. The case housing may include a plurality of case cavities. Each of the plurality of case cavities may be configured to receive at least one of a plurality of power sources.

Each one of the plurality of power sources may be removable from and insertable into the charging case 32. For example, each one of the plurality of power sources may be removable from charging case 32 without requiring the use of a tool so that the power sources can be removed using a user's hand alone. Alternatively, the plurality of power sources may be permanently fixed in the charging case 32. For example, use of a tool (such as a screwdriver) may be required in order to remove each one of the plurality of power sources from the charging case 32 so that the power sources cannot be removed using a user's hand alone.

The case power source may be configured to charge each of the plurality of removable power sources inserted in the plurality of case cavities. The charging case 32 may receive the aerosol-generating device 34 within a mounting section 38. The charging case 32 may include one or more couplers configured to releasably retain the aerosol-generating device 34 to the mounting section 38.

The aerosol-generating 34 device may include a heater for heating an aerosol-forming substrate and a device housing that may include a plurality of power source cavities. Each of the plurality of power source cavities may be configured to receive at least one of a plurality of removable power sources. The aerosol-generating device 34 may be configured to receive an aerosol-generating article such as article 36. The aerosol-generating device 34 may be configured to heat the aerosol-generating article 36.

Figure 3A:
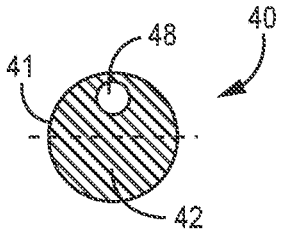
FIGS. 3A-3D are schematic diagram views of an aerosol-generating device.
Figure 3B:
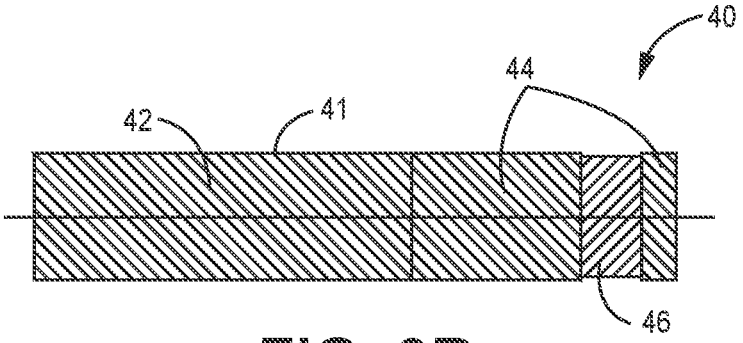
Figure 3C:
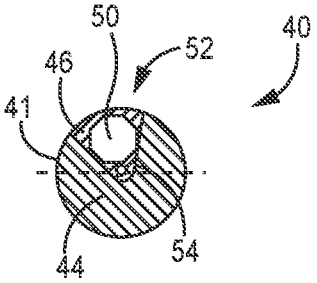
Figure 3D:
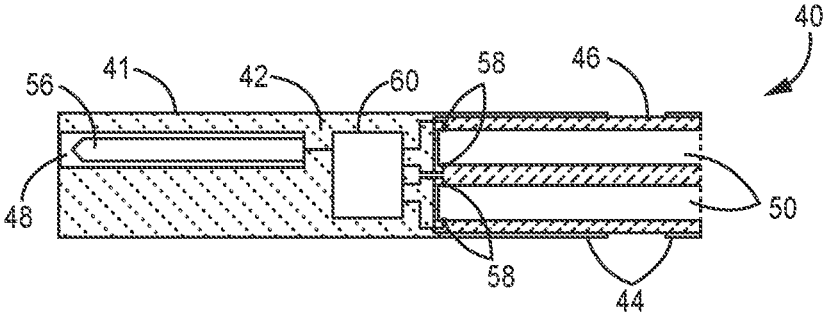

The aerosol-generating device depicted in FIGS. 3A-3D illustrates an aerosol-generating device 40 that includes a housing 41. FIG. 3A depicts a distal end view of the aerosol-generating device 40. FIG. 3B depicts a side view of the aerosol-generating device 40. FIG. 3C depicts a proximal end view of the aerosol-generating device 40. FIG. 3D depicts a cross-sectional side view of the aerosol-generating device 40. The housing 41 may include a heating portion 42, a cover portion 44, and a power source portion 46. The heating portion 42 may include a heater cavity 48 at a distal end of the aerosol-generating device 40 as depicted in FIG. 3A. The heater cavity 48 may be configured to receive an aerosol-generating article. The heater cavity 48 may include a heater 56 for heating aerosol-generating articles received in the heater cavity.

The power source portion 46 may include power source cavities 50. Openings to the power source cavities may be at a proximal end of the aerosol-generating device 40 as depicted in FIG. 3C. The power source cavities 50 may each be configured to receive at least one removable power source. The cover portion 44 may be configured to cover and provide access to the power source cavities 50. The power source portion 46 and the cover portion 44 may be configured to rotate relative to each other. The cover portion may include a window portion 52. The power source portion 46 may be rotatable relative to the cover portion 44 to expose at least one of the power source cavities 50 through the window portion 52. In other words, the cover portion 44 may be configured to cover the power source cavities 50 unless the power source portion 46 is rotated to expose one of the power source cavities. The aerosol-generating device 40 may further include a mounting pin 54. The power source portion 46 and the cover portion 44 may be rotatably coupled to the mounting pin 54. One of the power source portions 46 or the cover portion 44 may be rotatable relative to the other about the mounting pin 54.

The power source cavities 50 may include electrical contacts 58. The electrical contacts 58 may be located proximal a closed end of the power source cavities 50. The electrical contacts 58 may be operably coupled to heater 56 by circuitry 60. The aerosol-generating device 40 may be configured control power supplied to the heater 56 from one or more of a plurality of removable power sources received in power source cavities 50. The aerosol-generating device may further be configured to maintain the power provided to the heater 56 using any one or more of the plurality of removable power sources remaining in the power source cavities 50. The circuitry 60 may include any suitable electronics or devices for controlling power provided to the heater 56. For example, the circuitry 60 may operably couple each of the power source cavities 50 or received removable power sources in parallel to the heater 56. Such a configuration would allow the aerosol-generating device to provide power at a voltage equal to or lower than the maximum voltage of a removable power source. In another example, the circuitry 60 may include a controller to control the power provided to the heater 56. The controller may include one or more processors, memory, logic units, or other electronics to provide power control.

Figure 4A:
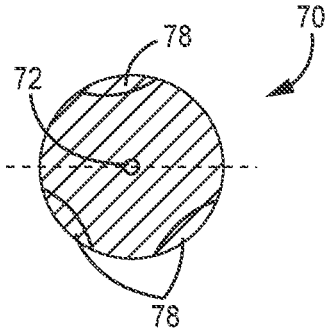
FIGS. 4A-4C are schematic diagram views of a power source portion of the aerosol-generating device.
Figure 4B:
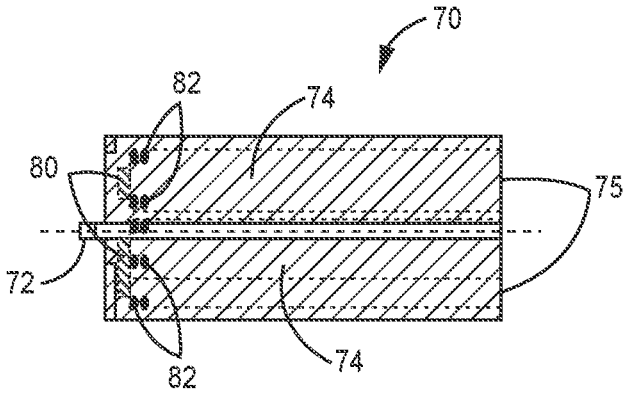
Figure 4C:
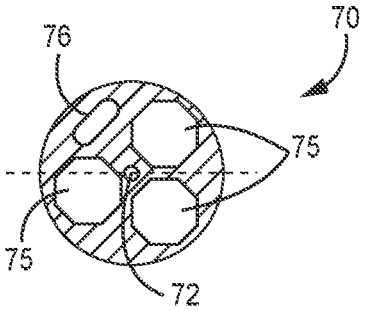

The power source portion depicted in FIGS. 4A-4C illustrates a power source portion 70 that includes a mounting pin 72, power source cavities 74, cavity openings 75, a charger port 76, and locking recess 78. FIG. 4A depicts a proximal end view of the power source portion 70. FIG. 4B depicts a cross-section side view of the power source portion 70. FIG. 4C depicts a distal end view of the power source portion 70.

The power source portion 70 may have a cylindrical shape. The mounting pin 72 may define a protrusion from the centre of the power source portion 70. The mounting pin 72 may be used to rotatably couple the power source portion 70 to a cover portion and enable the power source portion to rotate. The power source portion 70 may have locking recess 78 at a distal end as depicted in FIG. 4A. The locking recess 78 may allow a position of the power source portion 70 to be maintained. The locking recess 78 may be configured to engage with an elastic protrusion of a case portion. In other words, an elastic protrusion of a cover portion (not shown) may interact with the locking recess 78 and lock the power source portion 70 in a designated position until a user applies force to rotate the power source portion.

The power source portion 70 may include cavity openings 75 to power source cavities 74 at a proximal end as depicted in FIG. 4C. The power source cavities 74 may have cavity openings and a cross-sectional area slightly larger than the cross-sectional area of the removable power sources that the power sources are configured to receive. The power source cavities 74 may have a hexagonally shaped cross-sectional area. Each of the power source cavities 74 may have a biasing element 80 configured to be compressed. The biasing elements 80 may be located at a closed end of the power source cavities 74. The biasing elements 80 may be operable to engage removable power sources received in the power source cavities. The biasing elements 80 may include an elastic protrusion, a spring, or other biasing device. The biasing elements 80 may allow for easy removal of removable power sources when such removable power sources are not secured in the power source cavities 74 The power source cavities 74 may further include electrical contacts 82. The electrical contacts 82 may be configured to electrically couple to power sources received in the power source cavities 74 when the biasing element 80 is compressed by the power sources. The electrical contacts 82 may electrically couple power sources to a controller, a heating element, or the charger port 76.

The power source portion 70 may include a charger port 76. The charger port 76 may be located at a proximal end of the power source portion as depicted in FIG. 4C. The charger port 76 may be located adjacent to or proximal the cavity openings 75 of the power source cavities 74. The charger port 76 may be configured to couple to a charging cable. The charger port 76 may be electrically coupled to the electrical contacts 82 to provide power for charging removable power sources. The charger port 76 may be operably coupled to a controller of the aerosol-generating device.

Each of the power source cavities 74 may include a retention element at the cavity openings 75. Retention elements may include elastic protrusions, releasable tabs, or other devices to hold removable power sources in the power source cavities 74. Retention elements may be used when an aerosol-generating device does not have a cover portion. When the retention elements are released or removed the biasing elements 80 may push the heads of the removable power sources out of the power source cavities 74 to enable easy removal of the removable power sources.

The aerosol-generating device depicted in FIGS. 5A-5D illustrates an aerosol-generating device 100 with a power source portion 102 in various positions relative to a cover portion 104. The cover portion may include a window portion 106 configured to expose a portion of a proximal end of the power source portion 102 as depicted in FIGS. 5A-5D. The power source portion 102 and the cover portion 104 may be rotatably coupled by a mounting pin 108. The power source portion 102 may be rotatable about the mounting pin 108. Alternatively, the cover portion 104 may be rotatable about the mounting pin 108.

Figure 5A:
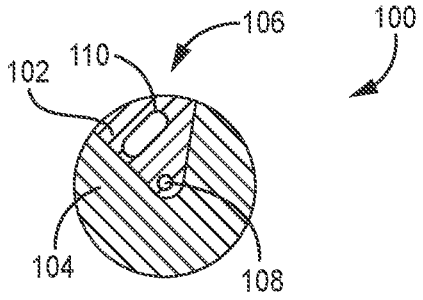
FIGS. 5A-5D are schematic diagram of positions of the power source portion relative to a cover portion for covering and providing access to power source cavities of the power source portion.
Figure 5B:
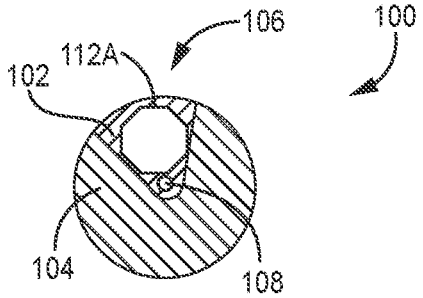
Figure 5C:
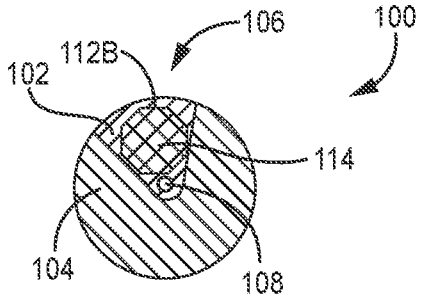
Figure 5D:
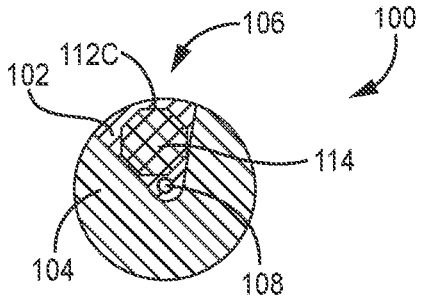

Rotation of either the power source portion 102 or the cover portion 104 to various locking positions may expose one of a charger port 110 and one of a plurality of power source cavities 112A-112C that may or may not have a removable power source 114 received therein. FIGS. 5A-5D depict four different locking positions. In one locking position, a charger port 110 may be exposed by the window portion 106 as depicted in FIG. 5A. In this locking position the power source cavities 112A-112C are covered, thereby securing any removable power sources received therein. In other locking positions, one of the power source cavities 112A-112C are exposed allowing a removable power source 114 to be received in or removed from the exposed power source cavity.

Figure 6A:
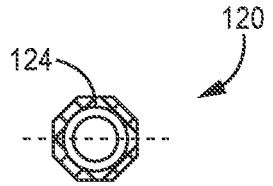
FIG. 6A-6C are schematic diagram views of a removable power source.
Figure 6B:
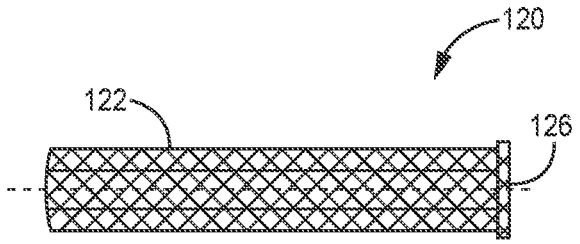
Figure 6C:
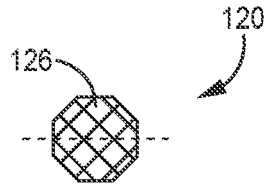

The power source device depicted in FIGS. 6A-6C illustrates a removable power source 120 for an aerosol-generating device such as depicted in FIGS. 1-5. The removable power source 120 may include a body 122, electrical contacts 124, and a head 126.

The removable power source 120 may be an energy storage device. Energy storage devices may include, for example, batteries, lithium-ion batteries, rechargeable batteries, fuel cells, or other forms of energy storage. The body 122 may be configured to store energy. The stored energy may be electrical energy, chemical energy, or other form of energy storage. In one embodiment, the removable power source is, for example, a Trustfire 10440, 600 mAh 3.7V Rechargeable Li-ion Battery. The removable power source 120 may have an energy capacity in a range of about 250 mAh to about 600 mAh. The electrical contacts 124 may be configured to electrically couple with electrical contacts of an aerosol-generating device or a charger case.

The removable power source 120 may have a hexagonal shaped cross-sectional area. The head 126 may have a larger cross-sectional area than the body 122. The head 126 having a larger cross-sectional area than the body 122 may provide easier handling for a user. The body 122 may extend along a length or axis between the head 126 and the electrical contacts 124. In other words, the head 126 may be located at a distal end of the removable power source and the electrical contacts may be located at a proximal end of the removable power source. The electrical contacts 124 may electrically couple the energy stored in the removable power source 120 to an aerosol-generating device, a charging case, a power source, or an energy source. The electrical contacts 124 may include any suitable electrically conductive material.

Figure 7:
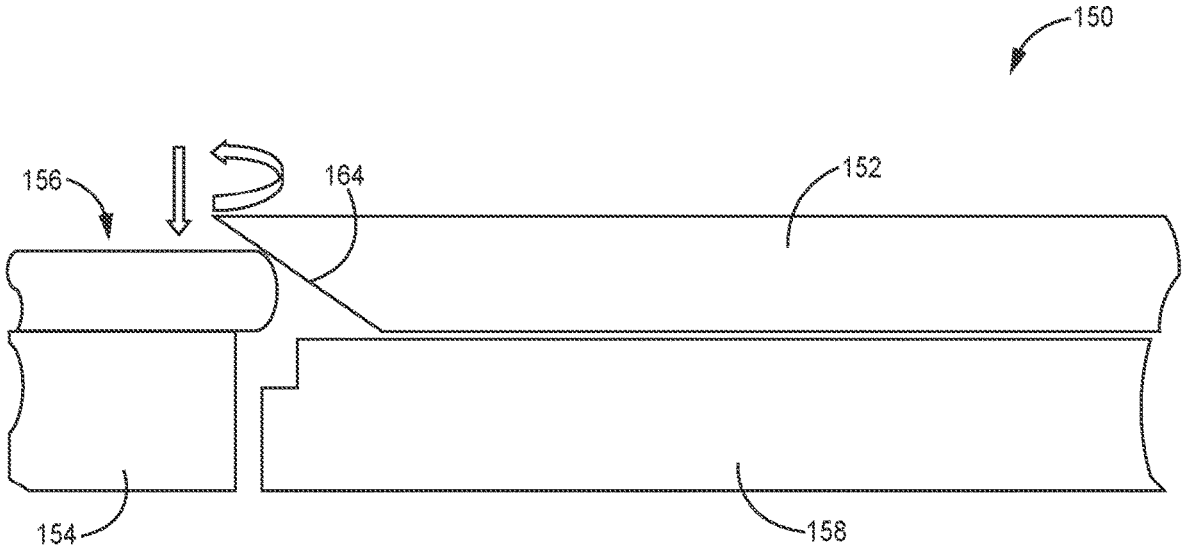
FIG. 7 is a schematic diagram of a cross-sectional view of an interaction of the cover portion and a removable power source.

The aerosol-generating device depicted in FIG. 7 illustrates an interaction between a cover portion 152 of an aerosol-generating device 150 and a removable power source 154. The aerosol-generating device may also include a power source cavity 156 and a power source portion 158. The cover portion 152 may include a window portion. The removable power source 154 may be received or inserted in the power source cavity 156 through the window portion. When the power source portion 158 is rotated the cover portion 152 may engage the removable power source 154 to push the removable power source further into the power source cavity 156 and against a biasing element. The cover portion 152 may include an angled edge 164 to enable the cover portion to smoothly push the removable power source 154 into the power source cavity 156 and to be moved over the power source cavity. Pushing the removable power source 154 against the biasing element may electrically couple electrical contacts of the removable power source 154 and electrical contacts of the aerosol-generating device 150.

Figure 8A:
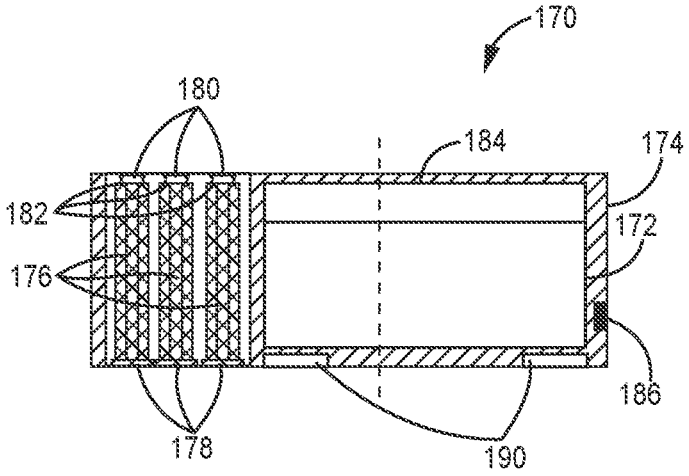
FIGS. 8A-8D are schematic diagram views of a charging case with a plurality of case cavities.
Figure 8B:
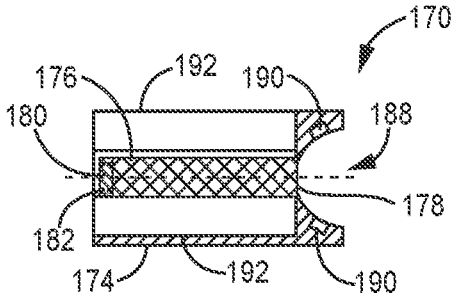
Figure 8C:
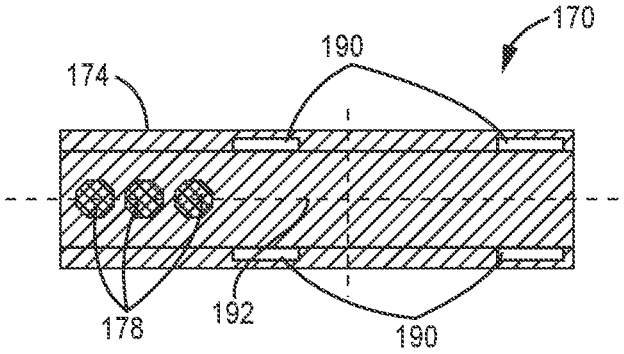
Figure 8D:
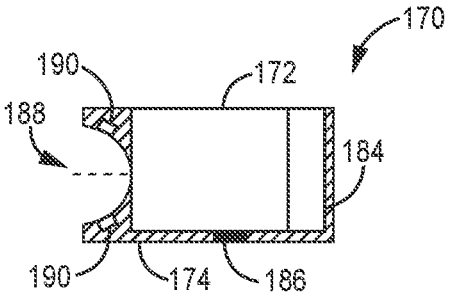

The charging case depicted in FIGS. 8A-8D illustrates a charging case 170 that may include a case power source 172 and a case housing 174. The case housing 174 may include a plurality of case cavities 176. Each of the case cavities 176 may be configured to receive at least one of a plurality of removable power sources 178. FIG. 8A is a lengthwise cross-sectional view of the charging case 170. FIG. 8B is a cross-sectional view of the case cavities 176 side of the charging case 170. FIG. 8C is an overhead view of a mounting section 188 side of the charging case 170. FIG. 8D is a cross-sectional view of the case power source 172 side of the charging case 170

The charging case 170 may be configured to charge one or more of the plurality of removable power sources 178 when received in the plurality of case cavities 176. Each of the case cavities 176 may include a biasing element 180 at the closed end of the cavities to engage a removable power source 178 received therein. Each of the case cavities 176 may include one or more electrical contacts 182 to electrically couple the received power sources 178 to the charging case 170. The electrical contacts 182 may be located the closed end of the case cavities 176. The electrical contacts 182 may include any suitable electrically conductive material.

The charging case 170 may further include electronics 184 configured to charge one or more of the plurality of removable power sources 176 based upon a current supply capability of the case power source 172. The electronics 184 may further be configured to charge the plurality of removable power sources 176 based on a voltage of each of the plurality of removable power sources 176. The electronics 184 may include one or more processors, controllers, memory, logic units, or other circuitry to control charging of power sources.

The charging case may further include a charger port 186 to charge the case power source 172, one or more of the plurality of removable power sources 172, or both the case power source and the one or more of the plurality of removable power sources. The charger port 186 may be operably coupled to the electronics 184, the case power source 172, or the electrical contacts 182. The charger port 186 may include any suitable input or interface to couple to a charging cable.

The charging case 170 may further include a mounting section 188 configured to receive an aerosol-generating device. The mounting section may include one or more couplers 190 to releasably retain the aerosol-generating device to the mounting section. The one or more couplers 190 may include one or more magnets or magnetic material. Access to the case cavities 174 may be provided via the mounting section 188 The shape of an external face of the mounting section 188 may be shaped to receive an aerosol-generating device. The mounting section 188 may include a wireless charging device to charge the aerosol-generating device.

The charging case 170 may include a storage portion 192. The storage portion 192 may be configured to receive aerosol-generating articles or aerosol-generating device accessories.

The exemplary embodiments described above are not limiting. Other embodiments consistent with the exemplary embodiments described above will be apparent to those skilled in the art.

The invention claimed is:

1. A charging case for an aerosol-generating device, the charging case comprising:

a case connector for receiving electrical power from an external source;

a plurality of case cavities, each of the plurality of case cavities being configured to receive at least one of a plurality of power sources;

a mounting section for connecting the aerosol-generating device to the charging case; and a case control unit arranged to:

charge a first one of the plurality of power sources via the case connector using electrical power from the external power source; and charge the aerosol-generating device connected to the mounting section via a second one of the plurality of power sources;

wherein each one of the power sources is removable and insertable into any one of the plurality of case cavities.

2. The charging case according to claim 1, wherein the case control unit is arranged to charge a plurality of the power sources via the case connector using electrical power from the external power source.

3. The charging case according to claim 1, wherein the mounting section comprises one or more couplers for coupling the aerosol-generating device to the charging case.

4. The charging case according to claim 3, wherein access to the case cavities is provided via the mounting section, wherein open ends of the case cavities are exposed upon removal of an aerosol-generating device from the mounting section.

5. The charging case according to claim 1, wherein a shape of an external face of the mounting section is shaped for receiving the aerosol-generating device.

6. An aerosol-generating device comprising:

a heater for heating an aerosol-forming substrate;

a device housing comprising a plurality of power source cavities, wherein each of the plurality of power source cavities is configured to receive at least one of a plurality of power sources, the device housing further comprising a power source portion comprising the plurality of power source cavities and a cover portion for covering and providing access to the power source cavities of the power source portion, wherein the power source portion and the cover portion are configured to rotate relative to each other; and a selector arranged to select a first power source from the plurality of power sources inserted into the plurality of power source cavities and arranged to provide power to the heater from the selected first power source;

wherein each one of the plurality of power sources is removable from and insertable into a corresponding one of the plurality of power source cavities.

7. The aerosol-generating device according to claim 6 wherein the cover portion comprises a window portion, wherein the power source portion is rotatable relative to the cover portion to expose at least one of the plurality of power source cavities through the window portion.

8. The aerosol-generating device according to claim 6, wherein the device housing further comprises a charging port for charging a power source received in any of the plurality of power source cavities.

9. The aerosol-generating device according to claim 6, wherein the aerosol-generating device is configured to:

control the power supplied to the heater from one or more of the plurality of power sources; and maintain the power provided to the heater using any one or more of the plurality of power sources remaining in the power source cavities.

10. The aerosol-generating device according to claim 6, wherein the device further comprises a mounting pin, and wherein the power source portion and the cover portion are rotatably coupled to the mounting pin.

11. The aerosol-generating device according to claim 6, wherein the cover portion comprises a window portion, wherein the power source portion is rotatable relative to the cover portion to expose at least one of the plurality of power source cavities through the window portion, and/or, wherein the aerosol-generating device further comprises a body portion comprising a protrusion and the power source portion comprises at least one locking recess, and wherein the protrusion is configured to engage the at least one locking recess to maintain a rotatable position of the power source portion.

12. The aerosol-generating device according to claim 6, wherein each power source cavity comprises:

a biasing element configured to be compressed, the biasing element operable to engage the at least one of the plurality of power sources; and an electrical contact configured to electrically couple to the at least one of the plurality of power sources when the biasing element is compressed by the at least one of the plurality of power sources.

13. A kit comprising, an aerosol-generating device comprising, a heater for heating an aerosol-forming substrate;

a device housing comprising a plurality of power source cavities, wherein each of the plurality of power source cavities is configured to receive at least one of a plurality of power sources, the device housing further comprising a power source portion comprising the plurality of power source cavities and a cover portion for covering and providing access to the power source cavities of the power source portion, wherein the power source portion and the cover portion are configured to rotate relative to each other; and a selector arranged to select a first power source from the plurality of power sources inserted into the plurality of power source cavities and arranged to provide power to the heater from the selected first power source;

wherein each one of the plurality of power sources is removable from and insertable into a corresponding one of the plurality of power source cavities, and a charging case comprising:

a case connector for receiving electrical power from an external source;

a plurality of case cavities, each of the plurality of case cavities being configured to receive at least one of a plurality of power sources;

a mounting section for connecting the aerosol-generating device to the charging case; and a case control unit arranged to:

charge a first one of the plurality of power sources via the case connector using electrical power from the external power source; and charge the aerosol-generating device connected to the mounting section via a second one of the plurality of power sources;

wherein each one of the power sources is removable and insertable into any one of the plurality of case cavities.

14. The kit according to claim 13, wherein the case control unit is arranged to charge a plurality of the power sources via the case connector using electrical power from the external power source.

15. The kit according to claim 13, wherein the mounting section comprises one or more couplers for coupling the aerosol-generating device to the charging case.

16. The kit according to claim 13, wherein access to the case cavities is provided via the mounting section, wherein open ends of the case cavities are exposed upon removal of an aerosol-generating device from the mounting section.

17. The kit according to claim 13, wherein a shape of an external face of the mounting section is shaped for receiving the aerosol-generating device.

18. The kit according to claim 13, wherein the cover portion comprises a window portion, wherein the power source portion is rotatable relative to the cover portion to expose at least one of the plurality of power source cavities through the window portion.

19. The kit according to claim 13, wherein the device housing further comprises a charging port for charging a power source received in any of the plurality of power source cavities.

20. The kit according to claim 13, wherein the aerosol-generating device is configured to:

control the power supplied to the heater from one or more of the plurality of power sources; and maintain the power provided to the heater using any one or more of the plurality of power sources remaining in the power source cavities.

* * * * *